US007066133B2

(12) United States Patent
Groddeck et al.

(10) Patent No.: US 7,066,133 B2
(45) Date of Patent: Jun. 27, 2006

(54) COVER PLATE FOR A CRANK CASE

(75) Inventors: Michael Groddeck, Meckenbeuren (DE); Marc Lotz, Salem-Grasbeuren (DE); Georg Ruetz, Immendtaad (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 74 days.

(21) Appl. No.: 10/861,917

(22) Filed: Jun. 7, 2004

(65) Prior Publication Data

US 2005/0011482 A1 Jan. 20, 2005

(30) Foreign Application Priority Data

Jun. 6, 2003 (DE) ..... 103 25 670

(51) Int. Cl.
*F02F 7/00* (2006.01)

(52) U.S. Cl. ..... 123/195 C; 184/106

(58) Field of Classification Search ..... 123/195 C; 184/106

See application file for complete search history.

(56) References Cited

U.S. PATENT DOCUMENTS 4,077,739 A * 3/1978 Heilenbach ..... 415/121.2
5,601,060 A * 2/1997 Smietanski et al. ..... 123/195 C
2003/0000495 A1 1/2003 Groddeck et al.

FOREIGN PATENT DOCUMENTS

DE 100 33 416 6/2001

* cited by examiner

*Primary Examiner*—Noah P. Kamen
(74) *Attorney, Agent, or Firm*—Crowell & Moring LLP

(57) ABSTRACT

A cover plate is provided for closing a crankcase of an internal-combustion engine on its underside. The cover plate has a suction point for collecting lubricant from the crankcase. With respect to the crankcase, the suction point is closed off by a screen plate. This screen plate comprises a first area with passage openings for the lubricant and a second area which is impervious to the lubricant. The screen plate has the effect that a reliable lubricant intake from the suction point is ensured even in the event of a tilt of the internal-combustion engine.

15 Claims, 3 Drawing Sheets

COVER PLATE FOR A CRANK CASE

BACKGROUND AND SUMMARY OF THE INVENTION

This application claims the priority of German Application No. 10325670.9-13, filed Jun. 6, 2003, the disclosure of which is expressly incorporated by reference herein.

The invention relates to a cover plate for a crankcase. Preferred embodiments of the invention relate to a cover plate for closing a crankcase of an internal-combustion engine on its underside, having a suction point for collecting lubricant from the crankcase and having a suction duct integrated in the cover plate, which suction duct connects the suction point with a pump opening for the intake of the lubricant by way of a pump.

From German Patent Document DE 100 33 416 C1 (corresponding U.S. Publication No.: US 2003/0000495 A1), a cover plate is known for closing a crankcase of an internal-combustion engine under its underside. The cover plate extends over the entire area of the crankcase. The pumps, the heat exchangers and the filters are arranged on the cover plate. Ducts for guiding media, such as the lubricant and the cooling water, are integrated in the cover plate. One indentation respectively for collecting lubricant is constructed in the cover plate on the power side and on the side opposite the power side. In the continued text, this indentation is called a suction point. By way of a fluid guiding device, the lubricant dripping down from the crankshaft space is fed to these suction points. The lubricant in the suction point is conveyed by way of a suction duct in the cover plate by a suction pump into chambers of the crankcase. In the case of this arrangement, it is problematic that, in the event of a tilt of the internal-combustion engine, the suction pump may deliver air out of the suction point. An avoiding of this condition for as long as possible also in the event of major tilts can be achieved only by a test-related optimization. However, this requires high expenditures.

It is an object of the invention to ensure reliable lubricant delivery in all operating positions.

This object is achieved by providing a cover plate for closing a crankcase of an internal-combustion engine on its underside, having a suction point for collecting lubricant from the crankcase and having a suction duct integrated in the cover plate which suction duct connects the suction point with a pump opening for the intake of the lubricant by way of a pump, wherein the suction point is closed by a screen plate with respect to the crankcase.

Further advantageous features of preferred embodiments of the invention are described herein and in the claims.

Preferred embodiments of the invention provide that the suction point is closed by a screen plate with respect to the crankcase. The screen plate, in turn, comprises a first area with passage openings for the lubricant and a second area which is impervious to the lubricant. In this case, the second area covers the connection point of the suction duct with the suction point. By way of the screen plate, a chamber is formed with the suction point. In the second area of the screen plate, this chamber is closed with respect to the crankcase. In the event of a tilt, a corresponding lubricant volume can therefore form inside this chamber. Since the lubricant is taken in from this area, this ensures a reliable lubricant supply.

An advantage of the invention is the fact that the geometrical change at the suction point is easy to design. This ensures a reliable dry sump lubrication, while the position of the crankcase is geodetically changed in comparison to the horizontal position. In other words: The lubricant is kept away from the rotating parts of the internal-combustion engine. A splashing of the rotating parts is thereby effectively prevented. The invention can be implemented at low expenditures and is almost neutral with respect to costs.

In a further development of the invention, it is provided that the area of the passage openings in the screen plate corresponds to the area of the pump opening. As a result, the effect is achieved that the flow velocity of the lubricant remains constant. The swirling of the lubricant is reduced.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
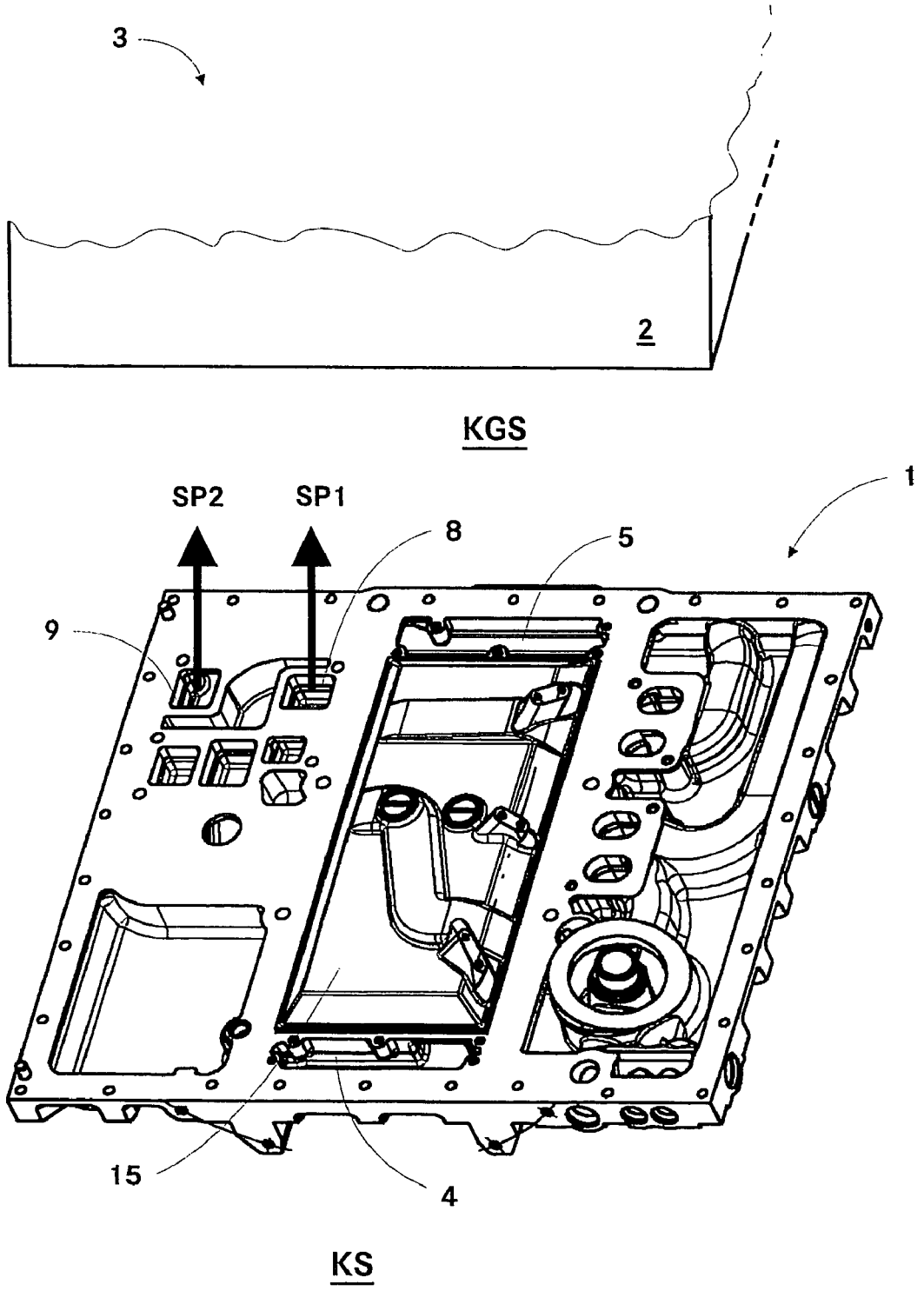
FIG. 1 is a perspective view of a cover plate, constructed according to a preferred embodiment of the invention.

FIG. 1 is a perspective view of a cover plate 1. Such a cover plate is generally known from German Patent Document DE 100 33 416 C1 (corresponding U.S. Publication No. US 2003/0000495 A1), which is part of the disclosure content of this application being incorporated herein by reference thereto. The cover plate 1 closes a crankcase 2 of an internal-combustion engine 3 on its underside. In this case, the cover plate 1 extends over the entire area of the crankcase 2. The pumps, that is, the suction and delivery pumps, the filters and the heat exchangers are arranged on the cover plate 1. For reasons of clarity, these are not shown in FIG. 1. On the power side KS, a first suction point 4 is constructed in the cover plate 1. A second suction point 5 is constructed on the side KGS opposite the power side KS. The lubricant dripping down from a crankshaft space is fed by a guiding device 15 to the first suction point 4 and to the second suction point 5. The suction points are used as a collection space. The first suction point 4 is connected with a first pump opening 8 by way of a suction duct integrated in the cover plate 1. The lubricant from the first suction point 4 is delivered by a suction pump by way of the suction duct and the first pump opening 8. In FIG. 1, the delivered volume flow is indicated by an arrow and by the reference symbol SP1. The second suction point 5 is also connected by way of a suction duct with a second pump opening 9. The lubricant of the second suction point 5 is delivered by another suction pump. This volume flow is illustrated in FIG. 1 by an arrow and the reference symbol SP2.

Figure 2:
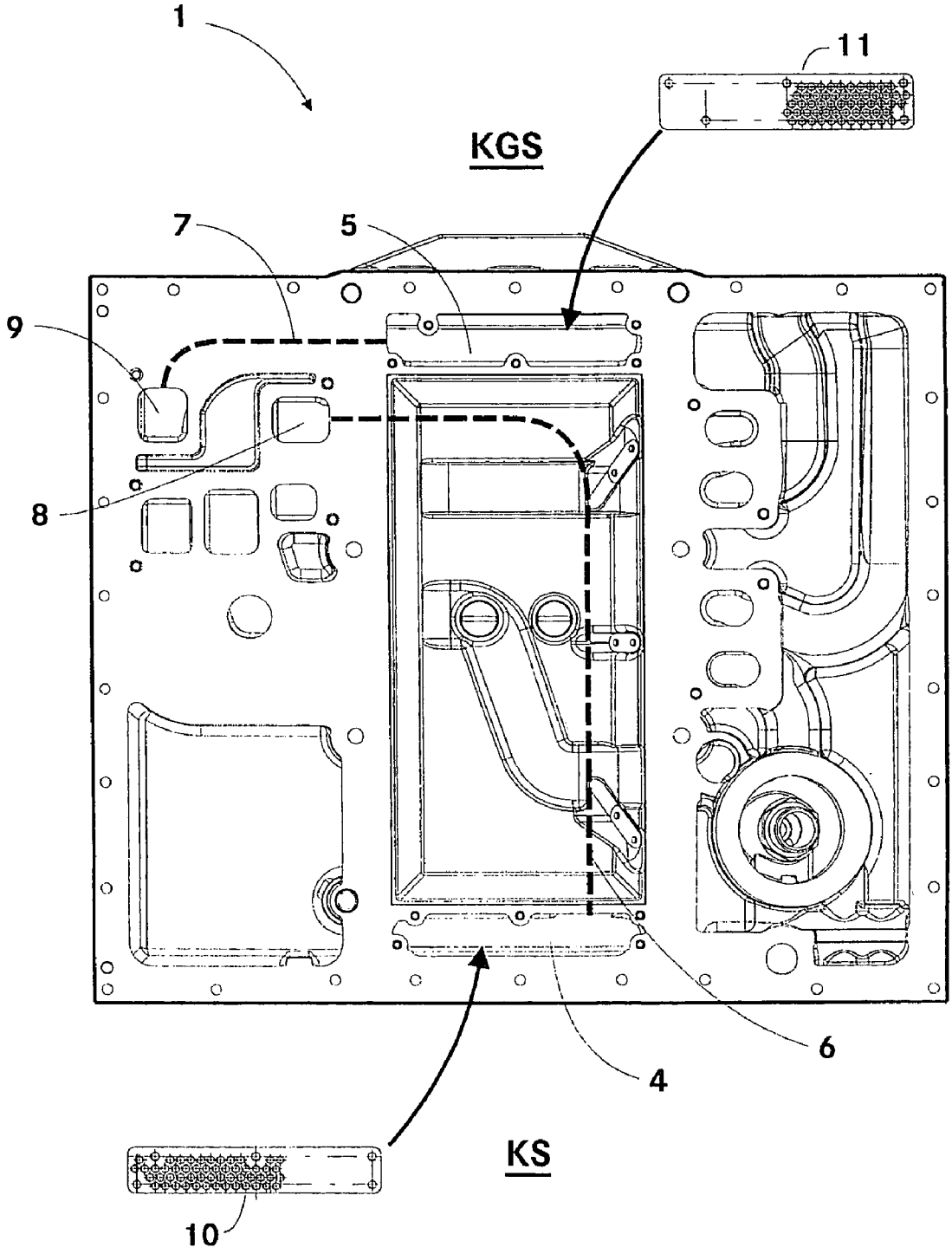
FIG. 2 is a top view of the cover plate of FIG. 1.

FIG. 2 is a top view of the cover plate 1. With respect to the plane of the drawing, the power side KS is situated below the cover plate 1 or the side KGS opposite the power side KS is situated above the cover plate 1. At reference number 6, a first suction duct is indicated by a broken line, which suction duct connects the first suction point 4 with the first pump opening 8. Reference number 7 indicates a second suction duct which connects the second suction point 5 with the second pump opening 9. Reference number 10 shows a first screen plate. The first screen plate 10 closes the first suction point 4 with respect to the crankcase. A more detailed explanation takes place in connection with FIG. 3. The first screen plate 10 comprises a first area 12 with passage openings 14 for the lubricant and a second area 13 impervious to the lubricant. The first screen plate 10 is arranged on the first suction point 4 such that the second area 13 covers the connection point of the first suction point 4 with the first suction duct 6. Together with the first screen plate 10, the first suction point 4, in the second area, forms a closed chamber with respect to the crankcase. In the event of a tilt of the internal-combustion engine, the lubricant collects in this chamber, so that the suction pump, out of the first suction point 4, reliably delivers the lubricant independently of the geodetic position.

The second suction point 5 is closed by a second screen plate 11 with respect to the crankcase. A more detailed explanation takes place in connection with FIG. 4. The second screen plate 11 also has a first area 12 with passage openings 14 for the lubricant and a second area 13 impervious to the lubricant. Because of the second suction duct, the second screen plate 11 is rotated by 180 degrees with respect to the installed position of the first screen plate 10. The functionality of the second screen plate 11 and the second suction point 5 is identical with the preceding description of the first screen plate 10 and the first section point 4.

Figure 3:
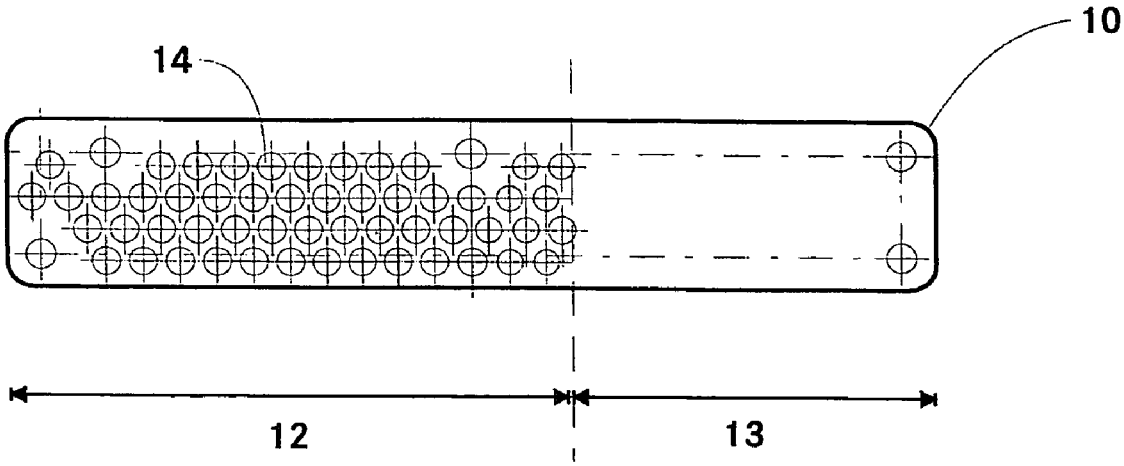
FIG. 3 is a view of a first screen plate for the cover plate of FIGS. 1 and 2.
Figure 4:
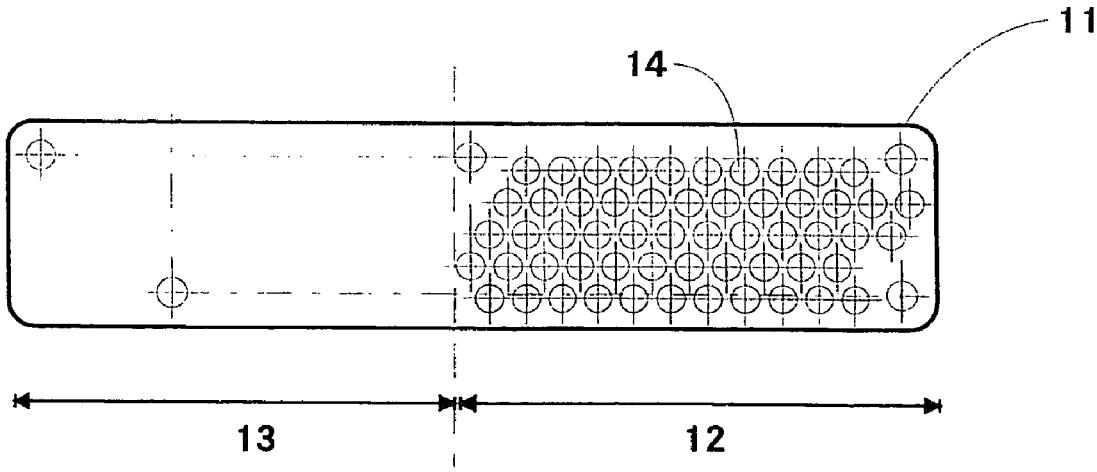
FIG. 4 is a view of a second screen plate for the cover plate of FIGS. 1 and 2.

The two screen plates 10 and 11 differ from one another in the construction of the first area 12 as depicted in FIGS. 3 and 4. In this case, the total area of the passage openings 14 of the first screen plate 10 is identical with the area of the second screen plate 11. By way of the area of the passage openings 14, it is achieved that the flow velocity is identical within the suction ducts 6 and 7. In practice, the screen plate is made of aluminum or plastic.

The following advantages of the invention are obtained from the preceding description:

By way of the screen plates 10, 11, a reliable lubricant delivery is ensured independently of the geodetic position of the internal-combustion engine;

an effective dry sump lubrication is achieved; that is, a splashing of the rotating parts is reliably prevented;

the implementation of the invention is simple and almost neutral with respect to costs because it consists of a simple change of the geometry at the suction point which is easy to design/illustrate.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A cover plate for closing a crankcase of an internal-combustion engine on its underside, having a suction point for collecting lubricant from the crankcase and having a suction duct integrated in the cover plate, which suction duct connects the suction point with a pump opening for the intake of the lubricant by way of a pump; wherein:

the suction point is closed by a screen plate with respect to the crankcase; and the screen plate has a first area with passage openings for the lubricant and a second area which is impervious to the lubricant.

2. The cover according to claim 1, wherein the area of the passage openings corresponds to the area of the pump opening.

3. The cover plate according to claim 2, wherein the screen plate is detachably connected with the cover plate.

4. The cover plate according to claim 2, wherein the cover plate has two of said suction points and corresponding suction ducts and pump openings, and wherein two of said screen plates are provided which close the respective suction points.

5. The cover plate according to claim 1, wherein the screen plate is arranged such that the second area of the screen plate covers the connection point of the suction point with the suction duct.

6. The cover plate according to claim 5, wherein the screen plate is detachably connected with the cover plate.

7. The cover plate according to claim 5, wherein the cover plate has two of said suction points and corresponding suction ducts and pump openings, and wherein two of said screen plates are provided which close the respective suction points.

8. The cover plate according to claim 1, wherein the screen plate is detachably connected with the cover plate.

9. The cover plate according to claim 8, wherein the cover plate has two of said suction points and corresponding suction ducts and pump openings, and wherein two of said screen plates are provided which close the respective suction points.

10. The cover plate according to claim 1, wherein the cover plate has two of said suction points and corresponding suction ducts and pump openings, and wherein two of said screen plates are provided which close the respective suction points.

11. The cover plate according to claim 10, wherein the two screen plates have different shapes to match respectively different shaped mounting positions of the suction points.

12. The cover according to claim 11, wherein the total area of the passage openings in the two screen plates is similar.

13. A cover plate for closing a crankcase of an internal-combustion engine on its underside, having a suction point for collecting lubricant from the crankcase and having a suction duct integrated in the cover plate, which suction duct connects the suction point with a pump opening for the intake of the lubricant by way of a pump; wherein:

the suction point is closed by a screen plate with respect to the crankcase;

the cover plate has two of said suction points and corresponding suction ducts and pump openings; and two of said screen plates are provided which close the respective suction points.

14. For closing a suction point in a cover plate for a crankcase on an underside of an internal-combustion engine, which cover plate has a suction point for collecting lubricant from the crankcase and a suction duct that is integrated in the cover plate and connects the suction point with a pump opening for the intake of the lubricant by way of a pump; a screen plate comprising:

a first area with passage openings for the lubricant; and a second area which is impervious to the lubricant;

wherein the area of the passage openings corresponds to an area of the pump opening.

15. The screen plate according to claim 14, wherein the screen plate has a configuration such that, in an installed state of said screen plate, the second area of the screen plate covers the connection point of the suction point with the suction duct.

* * * * *